US009181021B2

(12) United States Patent
Manera

(10) Patent No.: US 9,181,021 B2
(45) Date of Patent: Nov. 10, 2015

(54) PRESERVATION AND DISPENSING SYSTEM FOR CORKED BOTTLES

(71) Applicant: Jeffrey J. Manera, Palm Beach Gardens, FL (US)

(72) Inventor: Jeffrey J. Manera, Palm Beach Gardens, FL (US)

( * ) Notice: Subject to any disclaimer, the term of this patent is extended or adjusted under 35 U.S.C. 154(b) by 108 days.

(21) Appl. No.: 13/871,645

(22) Filed: Apr. 26, 2013

(65) Prior Publication Data

US 2013/0306673 A1 Nov. 21, 2013

Related U.S. Application Data

(60) Provisional application No. 61/687,513, filed on Apr. 26, 2012.

(51) Int. Cl.
*B65D 83/32* (2006.01)
*B67D 1/04* (2006.01)

(52) U.S. Cl.
CPC ..... *B65D 83/32* (2013.01); *B67D 1/0412* (2013.01); *B67D 2001/0481* (2013.01); *B67D 2001/0487* (2013.01)

(58) Field of Classification Search
USPC ..... 222/152, 399, 81–83, 464.5, 523, 564, 222/464.3, 398, 464.1–464.7, 394, 96, 97
See application file for complete search history.

(56) References Cited

U.S. PATENT DOCUMENTS 313,077 A * 3/1885 Hudson ..... 222/398
614,465 A * 11/1898 Habermann ..... 137/212
1,041,699 A * 10/1912 Thompson, Jr. ..... 222/91
2,060,512 A * 11/1936 Magill ..... 222/400.8
3,186,599 A * 6/1965 Levinson et al. ..... 222/82
3,343,701 A * 9/1967 Mahoney ..... 215/231
3,883,043 A * 5/1975 Lane ..... 222/82
4,011,971 A * 3/1977 Haydon ..... 222/399
4,045,525 A * 8/1977 Huggins ..... 261/124
4,392,578 A * 7/1983 Fipp et al. ..... 215/231
4,473,174 A * 9/1984 Heuser ..... 222/152
4,475,576 A * 10/1984 Simon ..... 141/98
4,477,477 A * 10/1984 Arter ..... 426/330.4
4,595,121 A * 6/1986 Schultz ..... 222/1
4,674,662 A * 6/1987 Bergstrom et al. ..... 222/399
4,691,842 A * 9/1987 Foures ..... 222/1
4,702,396 A * 10/1987 Gwiazda ..... 222/152
4,706,847 A * 11/1987 Sankey et al. ..... 222/1
4,809,884 A * 3/1989 Stackhouse ..... 222/153.04
4,856,680 A * 8/1989 Sitton ..... 222/152
4,934,543 A * 6/1990 Schmidt ..... 215/228
4,982,879 A * 1/1991 Corrado et al. ..... 222/400.7
4,984,711 A * 1/1991 Ellis ..... 222/82
4,995,534 A * 2/1991 Norman ..... 222/511
(Continued)

*Primary Examiner* — Kevin P Shaver
*Assistant Examiner* — Michael J Melaragno
(74) *Attorney, Agent, or Firm* — McHale & Slavin, P.A.

(57) ABSTRACT

The invention involves a system and method for preserving and dispensing liquids from a corked bottle. The system includes a manifold connected to a supply of pressurized gas. Fluidly connected to the manifold is a tube assembly, which extends through the cork of a bottle for the introduction of pressurized gas to the inner portion of the bottle. A second tube within the tube assembly is provided for the transfer of liquid out of the bottle to the manifold for dispensing through the dispensing valve. A floating tip assembly is provided on the distal end of the outer tube member for covering the gas and liquid openings during insertion of the tube assembly into the bottle. The floating tip assembly moves either automatically or manually after insertion of the tube assembly to allow gas and fluid to flow through the assembly.

16 Claims, 9 Drawing Sheets

(56) References Cited

U.S. PATENT DOCUMENTS

| | | | | |
|---|---|---|---|---|
| 5,139,179 | A * | 8/1992 | Cecil | 222/399 |
| 5,443,186 | A * | 8/1995 | Grill | 222/396 |
| 5,458,165 | A * | 10/1995 | Liebmann, Jr. | 141/64 |
| 5,566,730 | A * | 10/1996 | Liebmann, Jr. | 141/64 |
| 5,667,110 | A * | 9/1997 | McCann et al. | 222/386.5 |
| 6,220,311 | B1 * | 4/2001 | Litto | 141/67 |
| 7,395,949 | B2 * | 7/2008 | Ehret et al. | 222/386.5 |
| 7,712,637 | B2 * | 5/2010 | Lambrecht | 222/400.7 |
| 7,726,355 | B2 * | 6/2010 | Lemme et al. | 141/65 |
| 8,033,431 | B2 * | 10/2011 | Sommerfield et al. | 222/152 |
| 8,070,023 | B2 * | 12/2011 | Vitantonio et al. | 222/399 |
| 8,141,746 | B2 * | 3/2012 | Lambrecht | 222/152 |
| 8,225,959 | B2 * | 7/2012 | Lambrecht | 222/1 |
| 8,272,538 | B2 * | 9/2012 | Weinberg et al. | 222/152 |
| 8,348,097 | B2 * | 1/2013 | Nishino | 222/91 |
| 8,371,478 | B2 * | 2/2013 | Sommerfield et al. | 222/152 |
| 8,453,888 | B2 * | 6/2013 | Sommerfield et al. | 222/399 |
| 8,490,832 | B2 * | 7/2013 | Lambrecht | 222/82 |
| 8,640,919 | B2 * | 2/2014 | Lambrecht | 222/82 |
| 8,746,502 | B2 * | 6/2014 | Lambrecht | 222/1 |
| 2009/0224000 | A1 * | 9/2009 | Lopez et al. | 222/152 |
| 2010/0006603 | A1 | 1/2010 | Weinberg et al. | |
| 2010/0155419 | A1 * | 6/2010 | Nishino | 222/81 |
| 2011/0042418 | A1 * | 2/2011 | Lambrecht | 222/152 |
| 2011/0204093 | A1 * | 8/2011 | Lee | 222/152 |
| 2012/0031927 | A1 * | 2/2012 | Rivier et al. | 222/152 |
| 2012/0241476 | A1 * | 9/2012 | Lambrecht | 222/152 |
| 2012/0285988 | A1 * | 11/2012 | Lambrecht | 222/1 |
| 2013/0292423 | A1 * | 11/2013 | Lambrecht | 222/399 |
| 2013/0341348 | A1 * | 12/2013 | Lambrecht | 222/82 |
| 2014/0097198 | A1 * | 4/2014 | Lazaris et al. | 222/5 |
| 2014/0103065 | A1 * | 4/2014 | Lambrecht et al. | 222/81 |
| 2014/0110431 | A1 * | 4/2014 | Lambrecht | 222/82 |
| 2014/0224833 | A1 * | 8/2014 | Lambrecht | 222/82 |

* cited by examiner

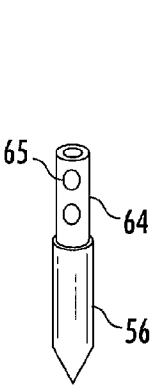
FIG. 26
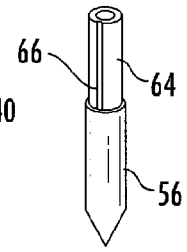
FIG. 25
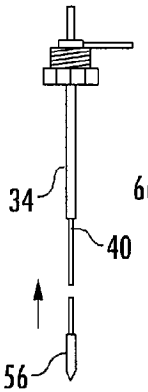
FIG. 24
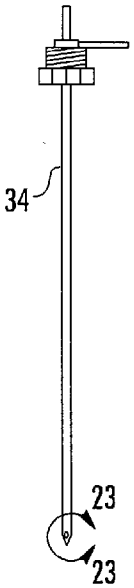
FIG. 22
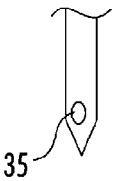
FIG. 23
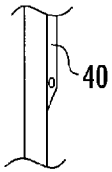
FIG. 21
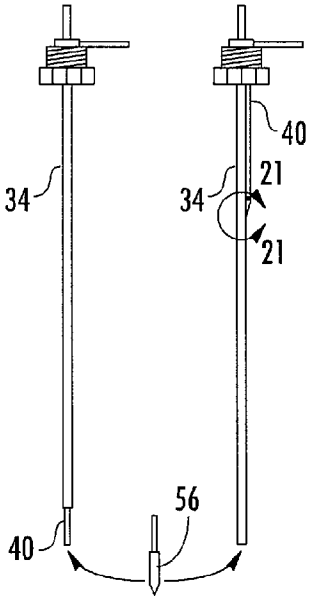
FIG. 20
FIG. 19
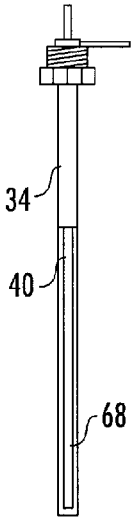
FIG. 18
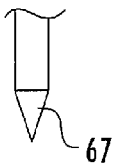
FIG. 17B
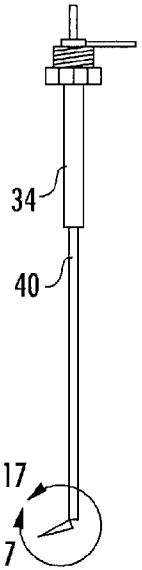
FIG. 16
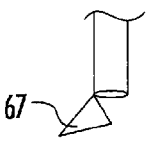
FIG. 17A

PRESERVATION AND DISPENSING SYSTEM FOR CORKED BOTTLES

RELATED APPLICATIONS

In accordance with 37 C.F.R 1.76, a claim of priority is included in an Application Data Sheet filed concurrently herewith. Accordingly, the present invention claims priority under 35 U.S.C. §119(e) to U.S. Provisional Application 61/687,513 entitled "PRESERVATION AND DISPENSING SYSTEM FOR WINE AND OTHER SEALED LIQUIDS" filed on Apr. 26, 2012. The contents of each of the above referenced applications are herein incorporated by reference in its entirety.

FIELD OF INVENTION

The present invention generally relates to dispensing systems, and more particularly to a system for dispensing and preserving liquids in corked bottles.

BACKGROUND INFORMATION

Numerous approaches have been applied to tapping into wine bottles while maintaining atmosphere within the bottle. For example, Lane U.S. Pat. No. 3,883,043 discloses a Dispenser for Vintage Wines. The dispenser includes a cap member having an offset gas container with a manually operated valve. A tube extends from the gas container into the bottle. A second tube is provided to allow the liquid out of the bottle.

Hayden, U.S. Pat. No. 4,011,971, discloses a tubular member to penetrate a cork-type closure to place the tubular member in fluid communication with the interior of the sealed container. The tubular member has two passages with one adapted to allow the free flow of liquid from the container, and the other adapted to allow the inflow of an innoxious gas to replace the removed liquid. The passage adapted to allow the inflow of an innoxious gas is connected to a compartment in a housing mounted on the tubular member having an innoxious gas retained under pressure. A valve is provided in the housing to allow the innoxious gas to flow into the container when the pressure in the container is below a preselected level.

U.S. Pat. Nos. 7,712,637 and 8,141,746 to Lambrecht disclose a wine extraction and preservation device and method. The device includes a source of pressurized gas connected to a non-coring needle. Pressurized gas is allowed to travel into the bottle. After a predetermined pressure is achieved, the bottle is laid on its side and a valve turned to allow pressurized fluid to come out of the bottle through the needle. The valve is operated to alternate between pressure and dispensing from the bottle.

U.S. Patent Application No. 2010/0155419 to Nishino discloses a Beverage Server System. The system includes a pair of needles, or one needle positioned inside of the other for extension through the cork member. Pressurized gas is provided to one needle and the wine is allowed to flow out of the container through the second needle.

U.S. Patent Application No. 2011/0204093 to Lee discloses a Wine Dispensing Device. The device includes a tubular helically threaded member. A second fluid tube extends through the threaded member and attaches to the distal end of the threaded member, which is displaceable toward the distal end of the bottle. Air is injected through the threaded member and liquid is ejected through the second tube.

These devices suffer from numerous drawbacks including that they are difficult to insert into bottles and easily breakable during use. Other drawbacks include valves that are difficult to construct or operate. The prior art devices also suffer from an inability to purge air out of the assembly prior to insertion into the bottle. Finally, the prior art fails to address portability and the need to expand to commercial volume with a like constructed piece of equipment.

Finally, there are ergonomic needs that a preservation and serving system must satisfy in order to achieve acceptance by the end user. The system must be easily and quickly assembled using minimal hardware and requiring a minimal number of tools. Further, the system should not require excessive strength to assemble or include heavy component parts. Moreover, the system must assemble together in such a way so as not to detract from the aesthetic appearance of the assembled system. Finally, the system should be expandable to provide for individual users as well as commercial enterprises.

Thus, the present invention provides a preservation and dispensing system for liquids in corked bottles, which overcomes the disadvantages of prior art preservation and dispensing systems. The preservation and dispensing system for liquids in corked bottles of the present invention not only provides for relative ease in the assembly and use, it also permits dispensing without the need to stop and re-pressurize the container. Further, the present system permits the tube and manifold assembly to be purged with inert gas to prevent the introduction of air into the bottle.

SUMMARY OF THE INVENTION

Briefly, the invention involves a system and method for preserving and dispensing liquids from a corked bottle. The system includes a manifold assembly connected to a supply of pressurized gas. Fluidly connected to the manifold is a tube assembly, which extends through the cork of a bottle for the introduction of pressurized gas to the inner portion of the bottle. A second tube within the tube assembly is provided for the transfer of liquid out of the bottle to the manifold for dispensing through the dispensing valve or orifice. A floating tip assembly is provided on the distal end of the outer tube member for covering the gas and liquid openings during insertion of the tube assembly into the bottle. The floating tip assembly moves either automatically or manually after insertion of the tube assembly to allow gas and fluid to flow through the assembly. The floating tip assembly also allows an inert gas to be purged through the tubing to displace air before insertion of the tubing assembly to eliminate the introduction of air into the bottle while also preventing debris from the cork from being lodged into the tubes.

Accordingly, it is an objective of the present invention to provide a system and method for preserving and dispensing wine or other liquids.

It is a further objective of the present invention to provide a system and method for preserving and dispensing wine that includes a floating tip assembly for covering inlet and outlet apertures of the tip assembly.

It is yet a further objective of the present invention to provide a floating tip assembly that is automatically deployable.

It is another objective of the present invention to provide a floating tip assembly that is manually deployable.

It is still another objective of the instant invention to provide a spring loaded floating tip assembly.

It is still yet another objective of the instant invention to provide a hingedly connected floating tip assembly.

Still yet another objective of the present invention is to provide a floating tip assembly that is deployed as a result of gas pressure;

Yet another objective of the present invention is to provide a floating non-coring tip assembly that is automatically deployable;

Other objectives and advantages of this invention will become apparent from the following description taken in conjunction with the accompanying drawings wherein are set forth, by way of illustration and example, certain embodiments of this invention. The drawings constitute a part of this specification and include exemplary embodiments of the present invention and illustrate various objects and features thereof.

BRIEF DESCRIPTION OF THE FIGURES

FIG. 16 is a side view of an alternative embodiment of the tube assembly of the present invention;

FIG. 17A is a partial view taken along lines 17-17 of FIG. 16;

FIG. 17B is a partial view taken along lines 17-17 of FIG. 16;

FIG. 18 is a side view of an alternative embodiment of the tube assembly of the present invention;

FIG. 19 is a side view of an alternative embodiment of the tube assembly of the present invention;

FIG. 20 is a side view of an alternative embodiment of the tube assembly of the present invention;

FIG. 21 is a partial side view taken along lines 21-21 of FIG. 20;

FIG. 22 is a side view of an alternative embodiment of the tube assembly of the present invention;

FIG. 23 is a partial side view taken along lines 23-23 of FIG. 22;

FIG. 24 is a side view of an alternative embodiment of the tube assembly of the present invention;

FIG. 25 is a side view of one embodiment of the tip member;

FIG. 26 is a side view of one embodiment of the tip member;

DETAILED DESCRIPTION OF THE PREFERRED EMBODIMENTS

Figure 1A:
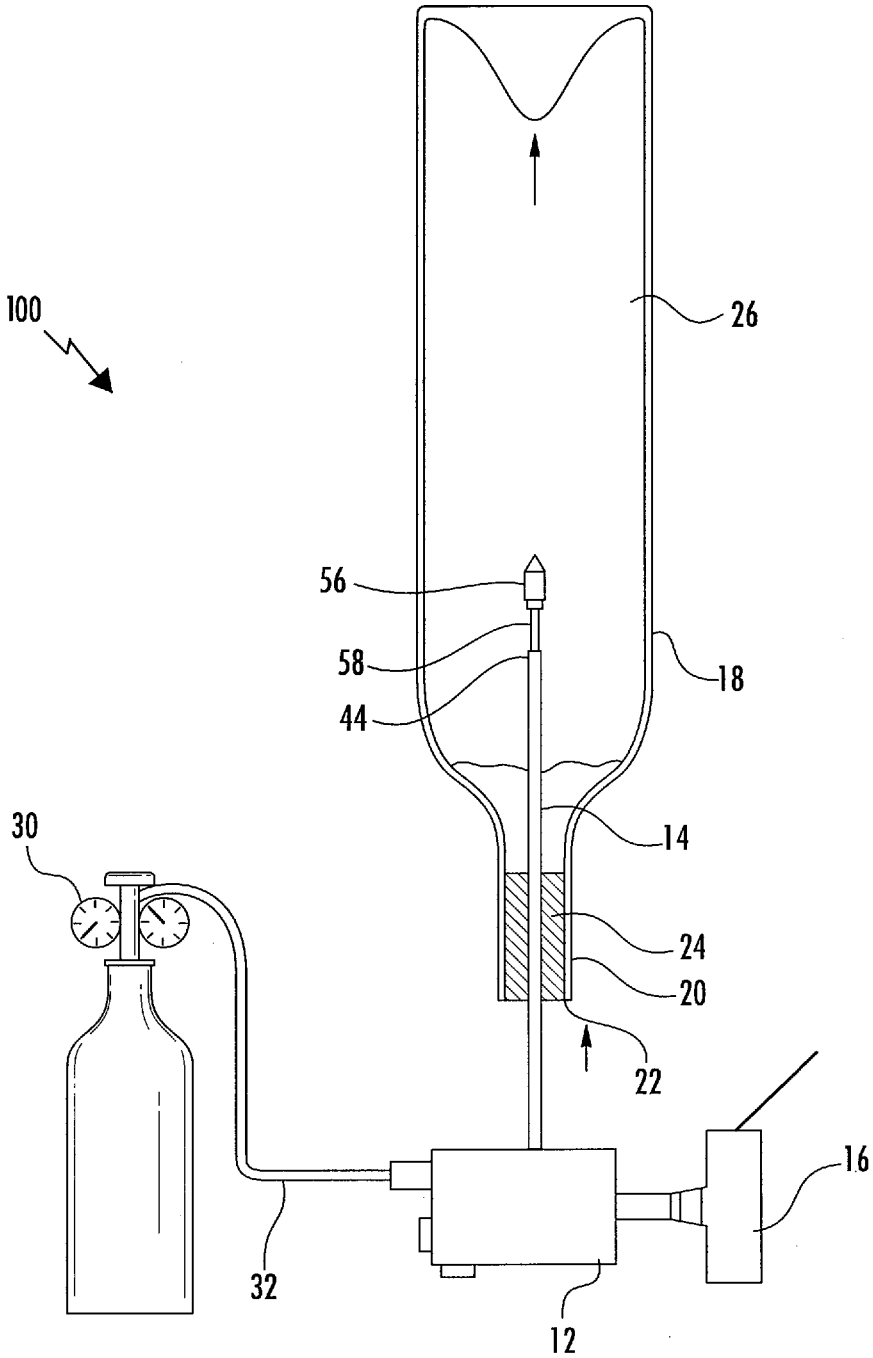
FIG. 1A is a side view of one embodiment of the present invention.
Figure 1B:
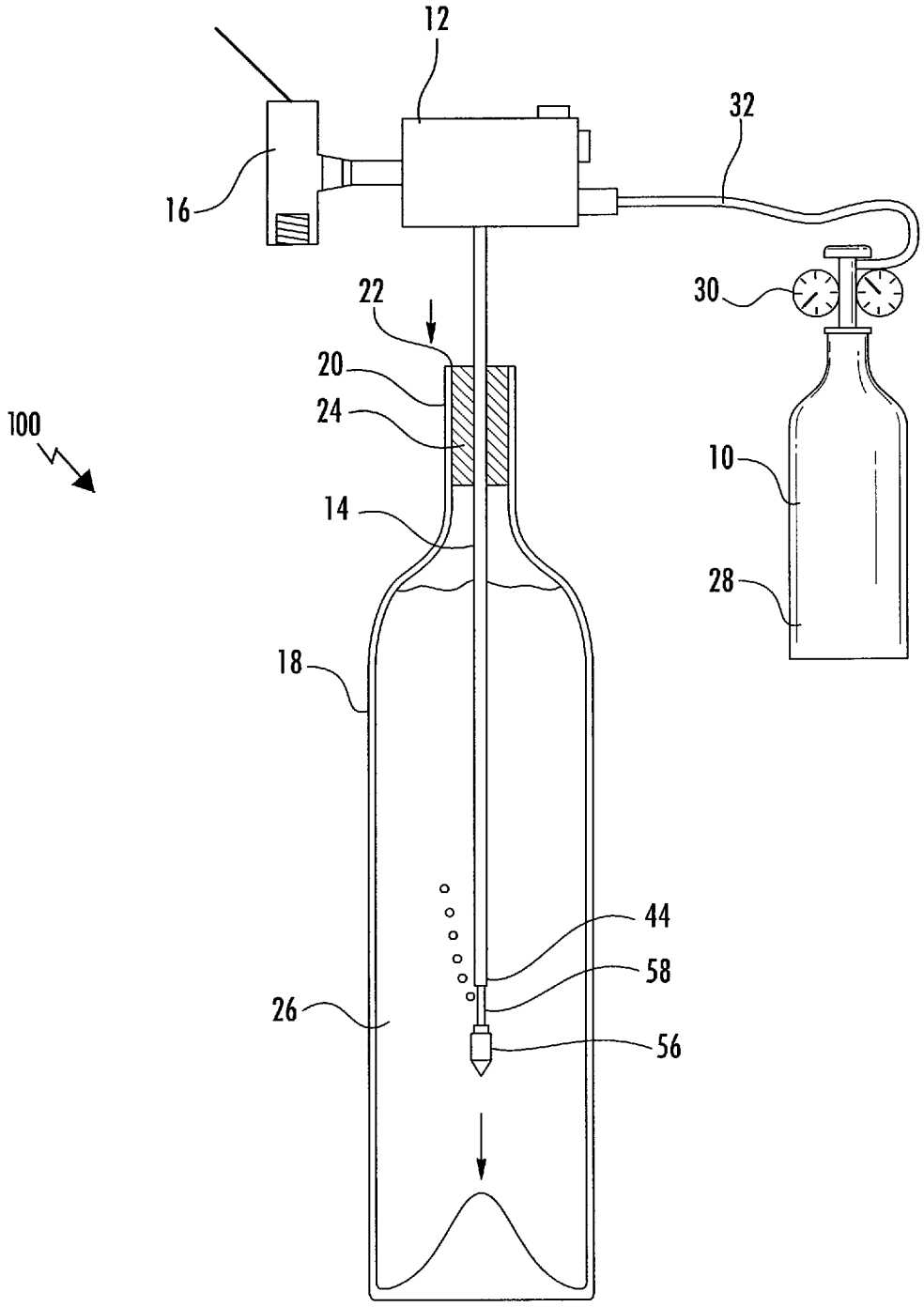
FIG. 1B is a side view, partially in section, of one embodiment of the present invention.
Figure 2:
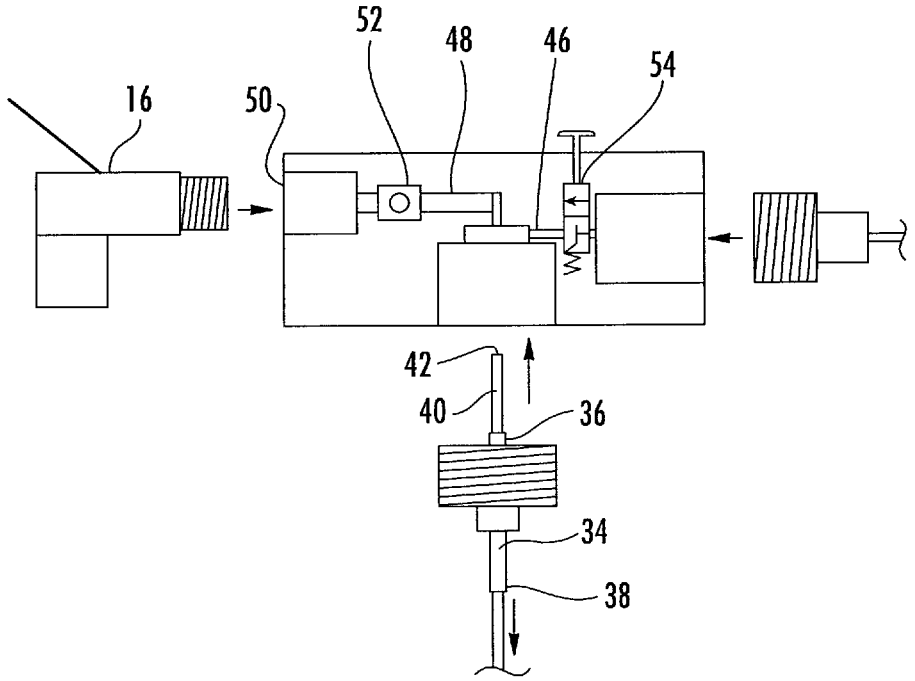
FIG. 2 is a partial side view of one embodiment of the manifold and valve assembly shown in FIG. 1.

While the present invention is susceptible of embodiment in various forms, there is shown in the drawings and will hereinafter be described a presently preferred embodiment with the understanding that the present disclosure is to be considered an exemplification of the invention and is not intended to limit the invention to the specific embodiments illustrated.

Referring generally to FIGS. 1-15, a preservation and dispensing system 100 for wine and other liquids in cork sealed containers is illustrated. The system includes a pressurized gas assembly 10, a manifold assembly 12, a tube assembly 14 and a valve assembly 16. In general, most wine or liquid bottles 18 have a neck portion 20. The neck portion has an inner neck diameter of about 18.5 millimeters at the mouth 22 of the bottle increasing to 21 millimeters before expanding to the full bottle width. A cork 24 is inserted through the mouth 22 and into the inner diameter of the neck of the bottle to contain the liquid 26 inside of the bottle and to prevent air from reaching the contents for extended preservation of the contents. The preservation and dispensing system for liquids in corked bottles of the present invention is constructed and arranged to be filled with inert gas prior to being inserted through the cork member 24 and into the liquid contents 26. The tube assembly can then be pressed through the cork member 24 allowing a floating tip assembly to automatically move to reveal apertures for the flow of pressurized gas and liquid. Inert gas from the pressurized gas assembly 10 is utilized to displace the liquid 26 within the bottle 18 which causes the liquid to flow through the tube assembly 14 into the manifold assembly 12 which routes the fluid 26 to the valve assembly 16 for manually controlled dispensing of the liquid.

The pressurized gas system 10 is generally constructed and arranged to supply a pressurized gas at a pressure higher than atmospheric pressure. The pressurized gas assembly includes a source of pressurized gas such as a cylinder 28. The cylinder 28 may be a large remote mounted cylinder or it may be a small single use cartridge without departing from the scope of the invention. If the large remote cylinder is utilized it will typically require a one or two stage regulator 30 to reduce the gas pressure to a usable amount. The cylinder may contain any one of several known inert gasses including, but not limited to carbon dioxide, argon, nitrogen or suitable combinations thereof. Tubing or hose extends from the regulator 30 to the manifold assembly 12. The manifold assembly (FIGS. 1A, 1B and 2) includes internal passages for routing the gas and liquid along a desired path. A preferred embodiment of the manifold assembly 12 includes a gas flow channel 46 extending from thesource of pressurized gas 10 to a first end 42 of the first tube member 40 and a liquid flow channel 48 extending from a first end 36 of the second tube 34 to a dispensing orifice 50. In a preferred embodiment, the dispensing orifice 50 includes a manually operable valve assembly 16 for controlling the flow of liquid out of the manifold assembly while allowing additional gas into the bottle 18. While the preferred manual valve is a ball valve, other manually operable valve assemblies may be utilized without departing from the scope of the invention so long as they are capable of restraining the flow of the pressurized liquid in an off position. In at least one embodiment, the liquid flow channel 48 includes a check valve 52; the check valve being constructed and arranged to allow liquid to flow outwardly from the channel while preventing air or liquid from flowing back into the liquid channel, and thus the bottle.

In an alternative embodiment, manifold assembly 12 includes a manually operable gas valve 54; the manually operable gas valve is constructed and arranged for controlling the inflow of the pressurized gas to the internal volume of the bottle in place of controlling liquid outflow as described earlier. In a most preferred embodiment, the manually operable gas valve is a spool valve; however, other types of gas control valves may be utilized without departing from the scope of the invention. In at least one embodiment, a check valve (not shown) is placed where the manually operable gas valve 54 is illustrated or anywhere along the gas flow channel. The check valve is constructed and arranged to allow the pressurized gas to flow inwardly to the gas flow channel while preventing the pressurized air or liquid from flowing out of the manifold assembly through the gas flow channel.

Referring to FIGS. 1-15, variations of the tube assembly 14 are illustrated. The tube assembly is generally constructed and arranged to pierce a cork while the cork is positioned in the neck portion of the bottle. In a most preferred embodiment, the tube assembly utilizes a non-coring tip 57. The tube assembly 14 includes a first tube member 40 fluidly connected to the manifold assembly for transfer of pressurized gas to the bottle and a second tube member 34 extending through the first tube member; the second tube member fluidly connected to the liquid stored in the bottle through the manifold assembly. In a preferred embodiment, the tube assembly 14 includes a floating tip member 56. The floating tip member is movable from a closed position, as illustrated in FIG. 5 where it covers the openings 58, 59 to the first and second tube members 40, 34, to an open position, illustrated in FIG. 4, uncovering the openings 58 to the tube members thereby allowing pressurized gas into the bottle and liquid out of the bottle. In a most preferred embodiment, the floating tip member is constructed and arranged to telescopingly travel along the first tube member. In this manner, the tip may be provided with a spring member 60 to cause the tip member to automatically traverse between the closed and said open positions, or the tip may be manually manipulated to cause its traversal, or the tip may utilize the pressurized gas to traverse the tip. In an alternative embodiment, the tip may be fixed to the second tube 34 and the first end 36 of the second tube may be allowed to slidingly cooperate with the manifold assembly 12 to provide the opening and closing of the tip. It should also be noted that while the preferred embodiment directs gas through the first inner tube and liquid is routed through the second outer tube member, this construction may be reversed as is illustrated in FIGS. 27-29 without departing from the scope of the invention.

Figure 3:
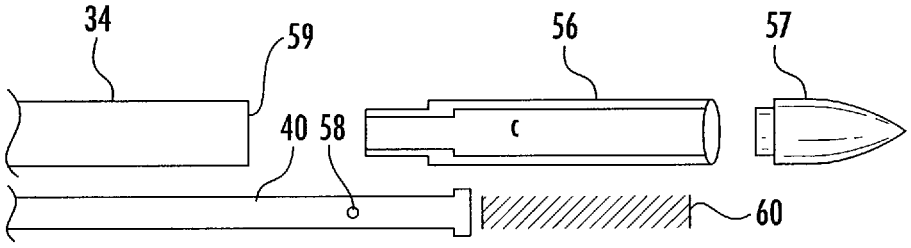
FIG. 3 is a partial exploded side view of the embodiment shown in FIG. 1 illustrating the components of one embodiment of the floating tip assembly.
Figure 4:
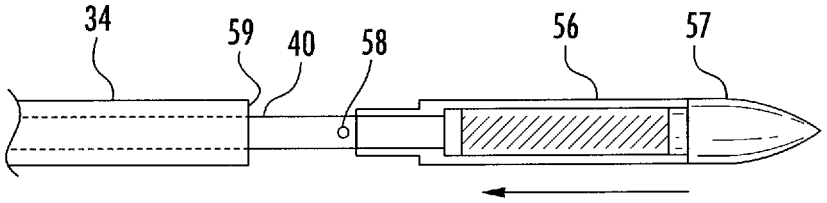
FIG. 4 is a partially sectioned side view of the floating tip assembly, illustrated in an extended position.
Figure 5:
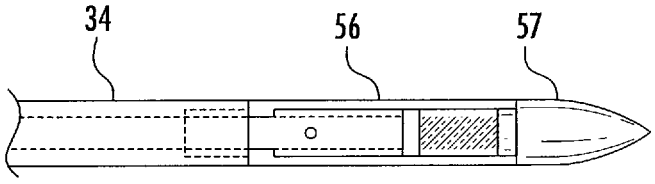
FIG. 5 is a partially sectioned side view of the floating tip assembly, illustrated in a closed position.
Figure 10:
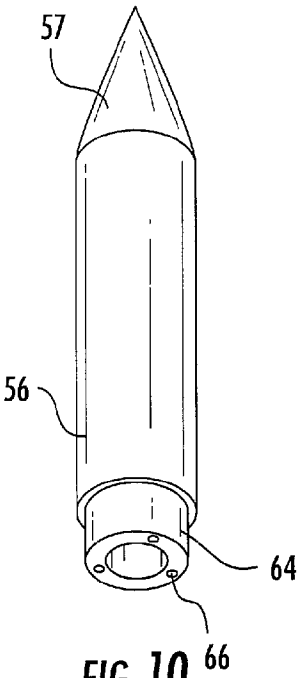
FIG. 10 is a partial perspective view of an alternative embodiment of the alignment collar and floating tip.
Figure 9:
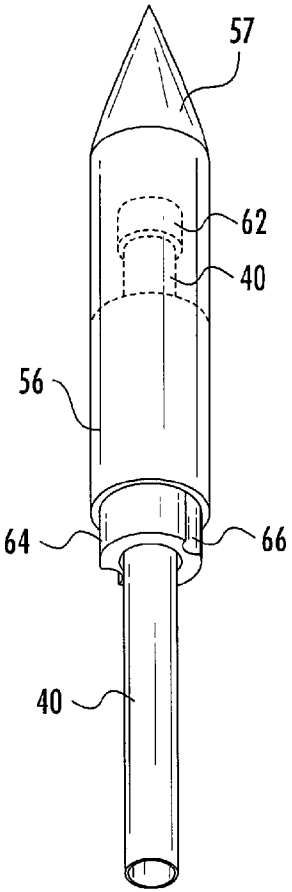
FIG. 9 is a partial perspective view illustrating the embodiment of the gas tube shown in FIG. 6 inserted into the floating tip.
Figure 8:
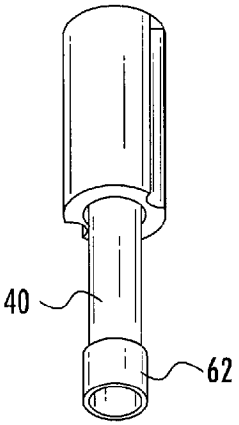
FIG. 8 is a partial perspective view illustrating the embodiment of the gas tube shown in FIG. 6 along with a portion of the floating tip.
Figure 7:
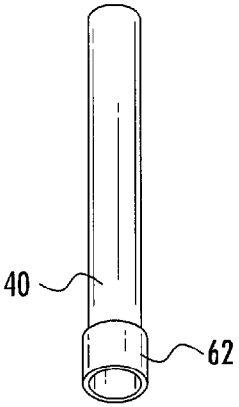
FIG. 7 is a partial perspective view illustrating the embodiment of the gas tube shown in FIG. 6.
Figure 6:
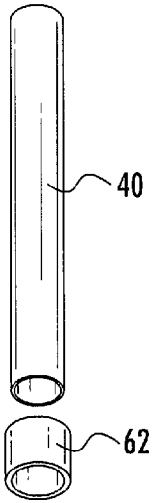
FIG. 6 is an exploded partial perspective view illustrating one embodiment of the gas tube of the present invention.
Figures 11, 12, 13, 14, 15:
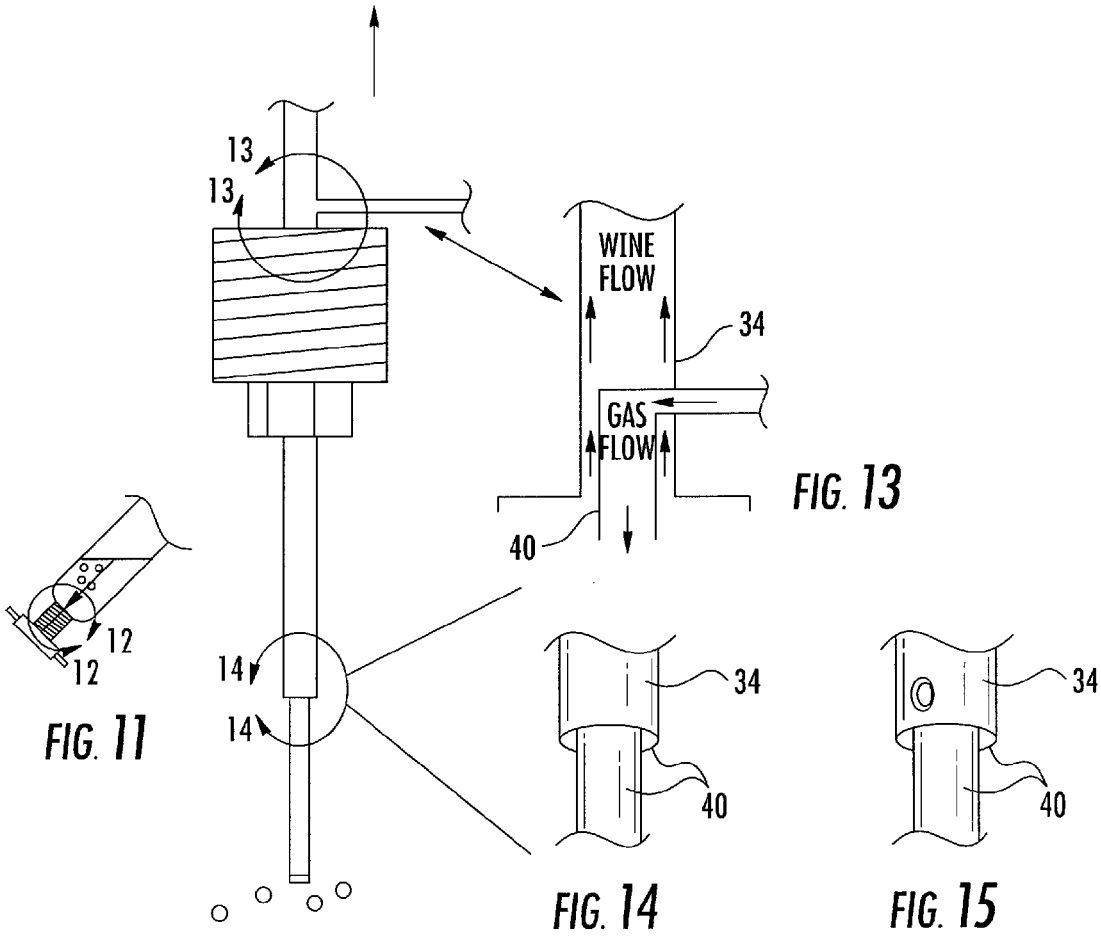
FIG. 11 is a side view of an alternative embodiment of the present invention.
FIG. 12 is a section view taken along lines 12-12 of FIG. 11.
FIG. 13 is a section view taken along lines 13-13 of FIG. 12.
FIG. 14 is a partial section view taken along lines 14-14 of FIG. 12.
FIG. 15 is a partial section view taken along lines 14-14, illustrating an alternative embodiment.

Referring to FIGS. 3-10, various embodiments of the second tube member are illustrated. In a preferred embodiment, the second tube member 34 includes an enlarged end portion 62 for retention of the tip member 56. The enlarged end 62 may be soldered, swaged, welded, formed, flared or otherwise secured or formed integrally to the second tube member without departing from the scope of the invention. In at least one embodiment, a vented bushing 64 is positioned within the floating tip member to cooperate with the inner surface of the first outer tube member to locate the tip with respect to the remainder of the tube assembly. The vented bushing is provided with at least one vent 66 which may be in the form of a channel or an aperture for the passage of pressurized gas therethrough. The vented bushing aids in purging the tube and manifold assembly. In operation, the floating tip can be pushed partially through the cork member, which holds the floating tip in a closed position. In this position, the pressurized gas is directed through the inner tube where it exits the distal end and flows back through the outer tube member and exits through the manifold dispensing orifice 50. If the manual valve is secured within the dispensing orifice, the valve can be opened to allow the pressurized gas to escape. Once the purging is complete, the tube assembly may be pushed the remainder of the way into the bottle. In this manner, air never comes into contact with the contents of the bottle, thereby preserving the contents from degradation. It should also be noted that while the bushing is illustrated as a separate piece from the remainder of the tip, the bushing may be formed as an integral part of the tip, as illustrated in FIGS. 3-5, by various methods such as casting, swaging, machining or the like without departing from the scope of the invention.

Referring to FIGS. 16-26, alternative embodiments of the tube assembly 14 are illustrated. The embodiments illustrated in FIGS. 16-17B show an embodiment including a pivoting tip member 66. The pivoting tip member may include a spring member (not shown) or shape memory alloy such as nitinol for providing a force to bias the tip to an open position. FIG. 18 illustrates an embodiment having a third tube member 68 positioned around the first and second tube members 40, 34. The embodiment illustrated in FIG. 19 shows a second tube 34 having a length that is longer than the first tube 40. The embodiment illustrated in FIGS. 20-21 shows the first and second tubes positioned in a side-by-side arrangement. The embodiment illustrated in FIG. 22 shows the second tube member 34 having an aperture 35 on its side, the first tube member 40 secured within the second tube so that its distal end opens to the aperture. The embodiment illustrated in FIG. 24 shows a short tube assembly wherein the bottle is placed in an inverted position for dispensing, see FIG. 1A also. FIG. 25 illustrates one embodiment of the tip assembly 56 having a groove along the side portion of the bushing 64 for allowing gas to purge through the tip. FIG. 26 illustrates an embodiment of the tip 56 having apertures 65 extending through its side for gas purging.

Figure 27:
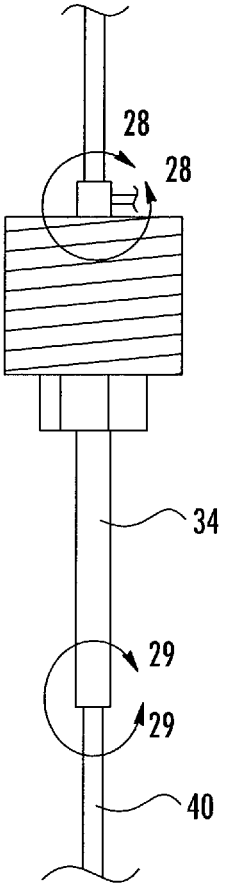
FIG. 27 is a partial view of the tip assemblies illustrated in FIGS. 16-24.
Figure 28:
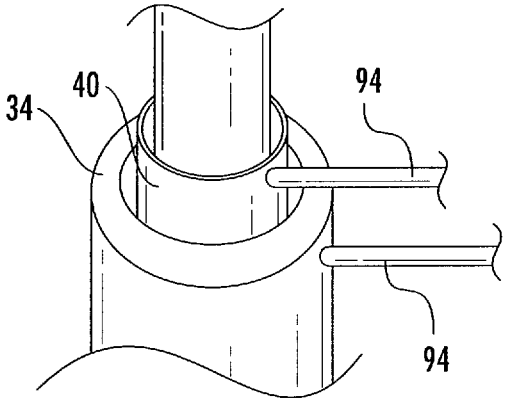
FIG. 28 is a partial view taken along lines 28-28 of FIG. 27.
Figure 29A:
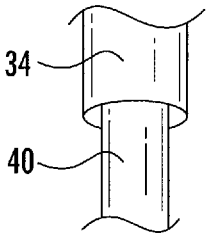
FIG. 29A is a partial perspective view taken along lines 29-29 of FIG. 27.
Figure 29B:
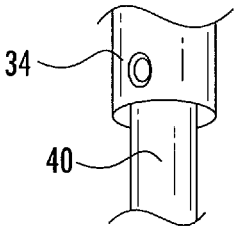
FIG. 29B is a partial perspective view taken along lines 29-29 of FIG. 27.

Referring to FIGS. 27-29, alternative embodiments of the present invention are illustrated. In these embodiments, the first and second tube functions are reversed, whereby the pressurized gas flows through the outer second tube 34 and the liquid is directed to the manifold through the inner first tube 40. In at least one embodiment, flow tubes 94 are utilized to provide connection to the manifold assembly.

Figure 30:
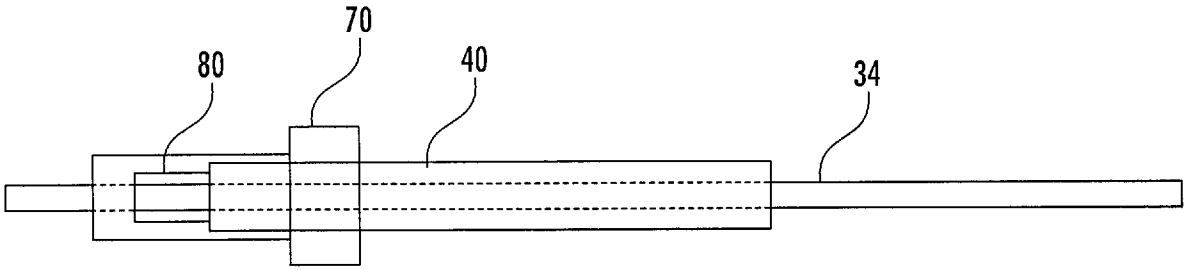
FIG. 30 is a side view of one embodiment of the tube assembly.
Figure 31:
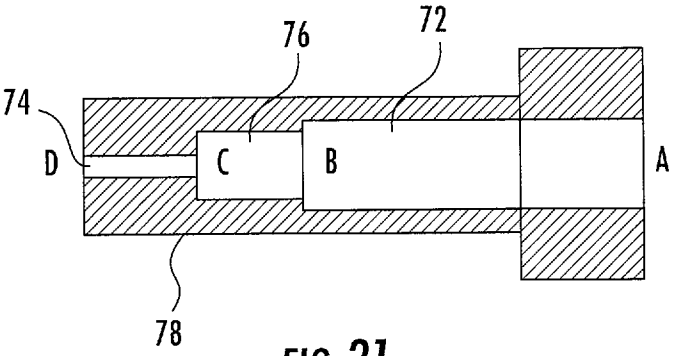
FIG. 31 is a partial side view of the tube assembly illustrated in FIG. 30.

Referring to FIGS. 30-31, an alternative embodiment of the tube assembly is illustrated. In this embodiment, a threaded member 70 is utilized to retain the tubes in position for removal and or replacement to the manifold assembly. The threaded member 70 includes a first bore 72 sized to cooperate with the first tube 40 to create a fluid tight connection therebetween, a second bore 74 is sized to cooperate with second tube 34 to create a fluid tight connection therebetween. This construction results in a port 76, which allows fluid to flow through tube 40 from the bottle to the liquid channel 48 in the manifold. The threaded outer surface 78 allows easy and rapid changing of the tube assemblies should one become damaged. It should also be noted that in place of threads, locking tapers, press fits, adhesive, tangent pins, set screws or the like may be utilized to hold the tube assembly in position within the manifold without departing from the scope of the invention.

It should also be noted that the teachings of the present invention may be applied in a multiple tap type arrangement. In these embodiments, the manifold may be elongated as a single piece, or individual manifolds may be arranged in a side-by-side arrangement whereby they may utilize a central pressurized gas system. This construction also permits refrigeration of multiple bottles within a refrigerated container, which may contain any number of bottles.

All patents and publications mentioned in this specification are indicative of the levels of those skilled in the art to which the invention pertains. All patents and publications are herein incorporated by reference to the same extent as if each individual publication was specifically and individually indicated to be incorporated by reference.

It is to be understood that while a certain form of the invention is illustrated, it is not to be limited to the specific form or arrangement of parts herein described and shown. It will be apparent to those skilled in the art that various changes may be made without departing from the scope of the invention and the invention is not to be considered limited to what is shown and described in the specification.

One skilled in the art will readily appreciate that the present invention is well adapted to carry out the objects and obtain the ends and advantages mentioned, as well as those inherent therein. Any compounds, methods, procedures and techniques described herein are presently representative of the preferred embodiments, are intended to be exemplary and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention, which are obvious to those skilled in the art, are intended to be within the scope of the following claims.

What is claimed is:

1. A preservation and dispensing system for corked bottles comprising:

a pressurized gas system constructed and arranged to supply a pressurized gas at a pressure higher than atmospheric pressure;

a manifold assembly fluidly connected to said pressurized gas system for routing said pressurized gas to an internal volume of a bottle through a tube assembly;

a tube assembly fluidly connected to said manifold assembly, said tube assembly including a distal tip constructed to pierce a cork while said cork is positioned in a neck portion of said bottle, said tube assembly including a first tube member fluidly connected to said pressurized gas through said manifold assembly, a second tube member extending through said first tube member, said second tube member fluidly connected to said manifold assembly, said tube assembly includes a floating tip member, said tip member movable via application of said pressurized gas from a closed position covering openings to said first and said second tube members, to an open position uncovering said openings to said first and said second tube members;

a manually operable valve assembly, said valve assembly fluidly connected to said manifold assembly, said valve assembly fluidly connected to said second tube through said manifold assembly, said manually operable valve constructed and arranged for controlling the inflow of said pressurized gas;

whereby operation of said valve assembly allows said pressurized gas to displace said tip member from a closed position to an open position, causing a fluid in said bottle to flow through said second tube and through a portion of said manifold assembly to exit said valve assembly.

2. The preservation and dispensing system for corked bottles of claim 1 wherein said tip member is constructed and arranged to telescope between said closed and said open position.

3. The preservation and dispensing system for corked bottles of claim 1 wherein said tip member is constructed and arranged to telescopingly travel along said second tube member.

4. The preservation and dispensing system for corked bottles of claim 1 wherein said tip member is fixed to said second tube member and said second tube member is constructed and arranged to telescopingly travel within said manifold assembly.

5. The preservation and dispensing system for corked bottles of claim 2 wherein said tip member includes a spring, said spring positioned to cause said tip member to automatically traverse between said closed and said open positions, once said tip member passes said cork in said bottle.

6. The preservation and dispensing system for corked bottles of claim 2 wherein said tip member is constructed and arranged for manual traversal between said closed and said open positions, upon application of said pressurized gas to said tip member.

7. The preservation and dispensing system for corked bottles of claim 2 including a vented bushing positioned in a first end of said tip member, said bushing sized for cooperation with an inner diameter of said second tube member, said vented bushing having an inner bore diameter sized to cooperate with an outer diameter of said first tube member.

8. The preservation and dispensing system for corked bottles of claim 7 wherein said bushing includes at least one vent sized to allow said pressurized gas to pass therethrough for purging said tube assembly and said manifold assembly.

9. The preservation and dispensing system for corked bottles of claim 1 wherein said tip member is constructed and arranged to pivot between said closed and said open position, upon application of said pressurized gas to said tip member.

10. The preservation and dispensing system for corked bottles of claim 9 wherein said tip member includes a spring, said spring constructed and arranged to bias said tip to an open position.

11. The preservation and dispensing system for corked bottles of claim 1 wherein said manifold assembly includes a gas flow channel extending from said source of pressurized gas to a first end of said first tube member, a liquid flow channel extending from a first end of said second tube to a dispensing orifice.

12. The preservation and dispensing system for corked bottles of claim 11 wherein said dispensing orifice includes a manually operable valve assembly for controlling the flow of liquid out of said manifold assembly.

13. The preservation and dispensing system for corked bottles of claim 12 wherein said manually operable valve assembly is a ball valve.

14. The preservation and dispensing system for corked bottles of claim 11 wherein said liquid flow channel includes a check valve, said check valve being constructed and arranged to allow liquid to flow outwardly from said channel while preventing air or liquid from flowing back into said liquid channel.

15. The preservation and dispensing system for corked bottles of claim 11 wherein said gas flow channel includes a check valve, said check valve being constructed and arranged to allow said pressurized gas to flow inwardly to said gas flow channel while preventing said pressurized air or liquid from flowing out of said manifold assembly through said gas flow channel.

16. The preservation and dispensing system for corked bottles of claim 12 wherein said manually operable valve is a spool valve.

* * * * *